US007032479B1

(12) United States Patent
Wang

(10) Patent No.: US 7,032,479 B1
(45) Date of Patent: Apr. 25, 2006

(54) PLIERS FOR E-SHAPED SNAP RINGS

(76) Inventor: Tien-Shui Wang, No. 232, Tou Tan Road, Taichung Hsien, Sha Lu Town (TW)

( * ) Notice: Subject to any disclaimer, the term of this patent is extended or adjusted under 35 U.S.C. 154(b) by 0 days.

(21) Appl. No.: 10/908,050

(22) Filed: Apr. 26, 2005

(51) Int. Cl.
*B25B 7/02* (2006.01)

(52) U.S. Cl. ..... 81/302; 29/229

(58) Field of Classification Search ..... 81/302, 81/421, 422, 423, 185.1
See application file for complete search history.

(56) References Cited

U.S. PATENT DOCUMENTS 797,541 A * 8/1905 Walker et al. ..... 12/117.2
1,557,370 A * 10/1925 Lane ..... 29/270
3,132,550 A * 5/1964 Sion ..... 81/423
3,619,890 A * 11/1971 Kubokawa ..... 29/229
4,316,315 A * 2/1982 Vogelnik ..... 29/229
4,793,224 A * 12/1988 Huang ..... 81/302
5,212,859 A * 5/1993 Hagerty ..... 29/229
5,327,802 A * 7/1994 Yu ..... 81/312
6,257,105 B1 * 7/2001 Lin ..... 81/302
2003/0041702 A1 * 3/2003 Kang ..... 81/302

* cited by examiner

*Primary Examiner*—David B. Thomas
*Assistant Examiner*—Robert Scruggs
(74) *Attorney, Agent, or Firm*—Alan D. Kamrath; Nikolai & Mersereau, P.A.

(57) ABSTRACT

A pair of pliers is disclosed for E-shaped snap rings. The pair of pliers includes two handles and two jaws. The handles are pivotally connected with each other. Each of the handles includes a first end and a second end so that the first ends of the handles are opened when the second ends of the handles are closed. Each of the jaws includes a first end, a second end and an oblique groove. The first end of each of the jaws is connected with the second end of one of the handles in a detachable manner. Near the second end each of the jaws is defined the oblique groove in order to receive a portion of an E-shaped snap ring. Thus, the E-shaped snap ring is opened when the first ends of the handles are closed.

21 Claims, 12 Drawing Sheets

PLIERS FOR E-SHAPED SNAP RINGS

BACKGROUND OF INVENTION

1. Field of Invention

The present invention relates to a pair of pliers for snap rings and, more particularly, to a pair of pliers for E-shaped snap rings.

2. Related Prior Art

In U.S. Pat. No. 6,257,105, there is disclosed a conventional pair of pliers for snap rings. This conventional pair of pliers is provided for C-shaped snap rings. A snap ring includes two ends each defining an aperture. This conventional pair of pliers includes two jaws 21 each includes tips 22 and 23. The tip 22 or 23 of each jaw 21 can be inserted in the aperture defined in each end of the C-shaped snap ring. Thus, the pair of pliers can be used to open the C-shaped snap ring. However, this conventional pair of pliers cannot be used to open E-shaped snap rings since an E-shaped snap rings does not include apertures for receiving the tips 22 or 23 of the jaws 21.

The present invention is therefore intended to obviate or at least alleviate the problems encountered in prior art.

SUMMARY OF INVENTION

According to the present invention, a pair of pliers includes two handles and two jaws. The handles are pivotally connected with each other. Each of the handles includes a first end and a second end so that the first ends of the handles are opened when the second ends of the handles are closed. Each of the jaws includes a first end, a second end and an oblique groove. The first end of each of the jaws is connected with the second end of one of the handles in a detachable manner. Near the second end each of the jaws is defined the oblique groove in order to receive a portion of an E-shaped snap ring. Thus, the E-shaped snap ring is opened when the first ends of the handles are closed.

The primary advantage of the pair of pliers is the ability to open E-shaped snap rings.

Other advantages and novel features of the invention will become more apparent from the following detailed description in conjunction with the drawings.

BRIEF DESCRIPTION OF DRAWINGS

The present invention will be described through detailed illustration of embodiments thereof referring to the drawings.

DETAILED DESCRIPTION OF EMBODIMENTS

Figure 4:
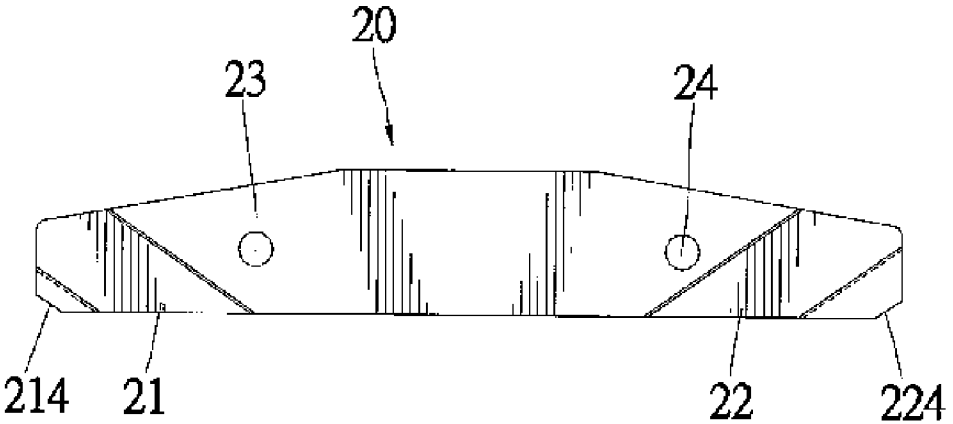
FIG. 4 is a top view of the jaw shown in FIG. 3.
Figure 5:
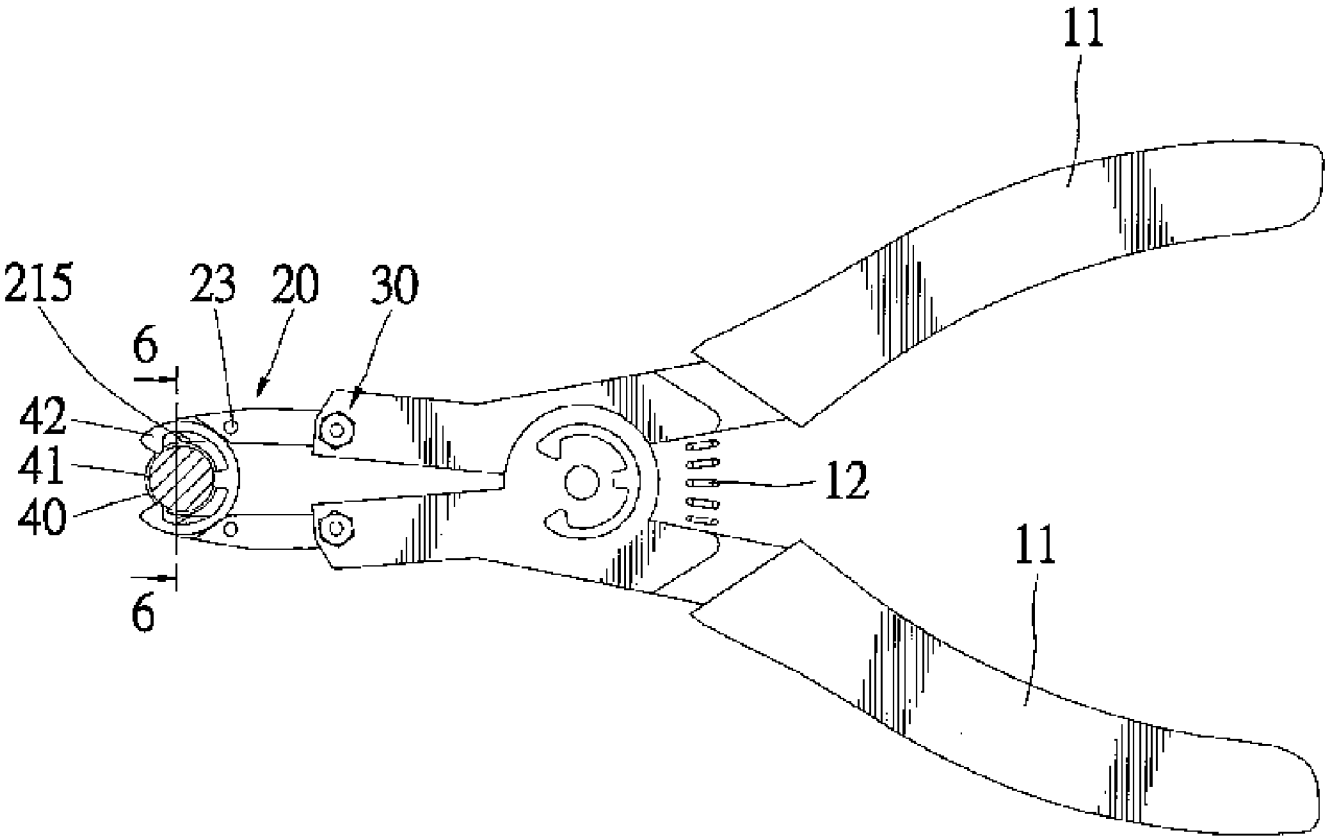
FIG. 5 is a top view of the pair of pliers shown in FIG. 1.

Referring to FIGS. 1 through 10, according to a first embodiment of the present invention, a pair of pliers 10 is provided for E-shaped snap rings such as that is referred to by "42" in FIG. 5. The pair of pliers 10 includes two handles 11 connected with each other pivotally. Each handle 11 includes a first end to be griped and a second end extended from the first end. When the first ends of the handles 11 are closed, the second ends of the same are opened. A spring 12 is compressed between the handles 111 in order to open the handles 11. A jaw 20 is connected with the second end of each handle 111 by means of a quick-release device 30. Thus, when the first ends of the handles 11 are closed, the jaws 20 open the E-shaped snap ring 42.

Figure 1:
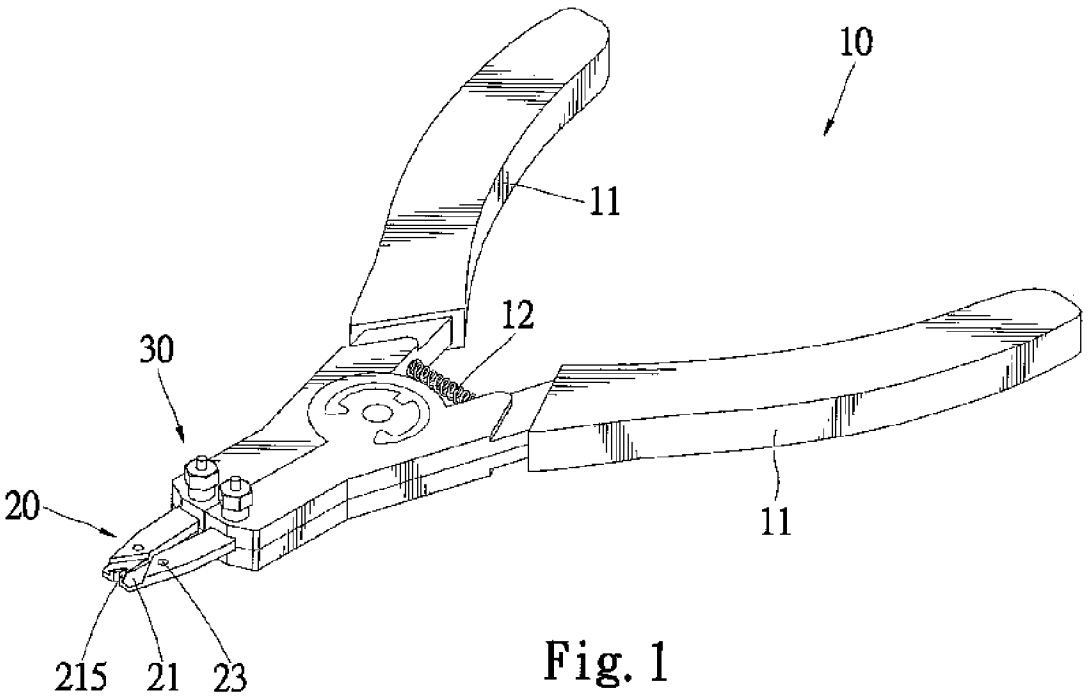
FIG. 1 is a perspective view of a pair of pliers for E-shaped snap rings according to a first embodiment of the present invention.
Figure 2:
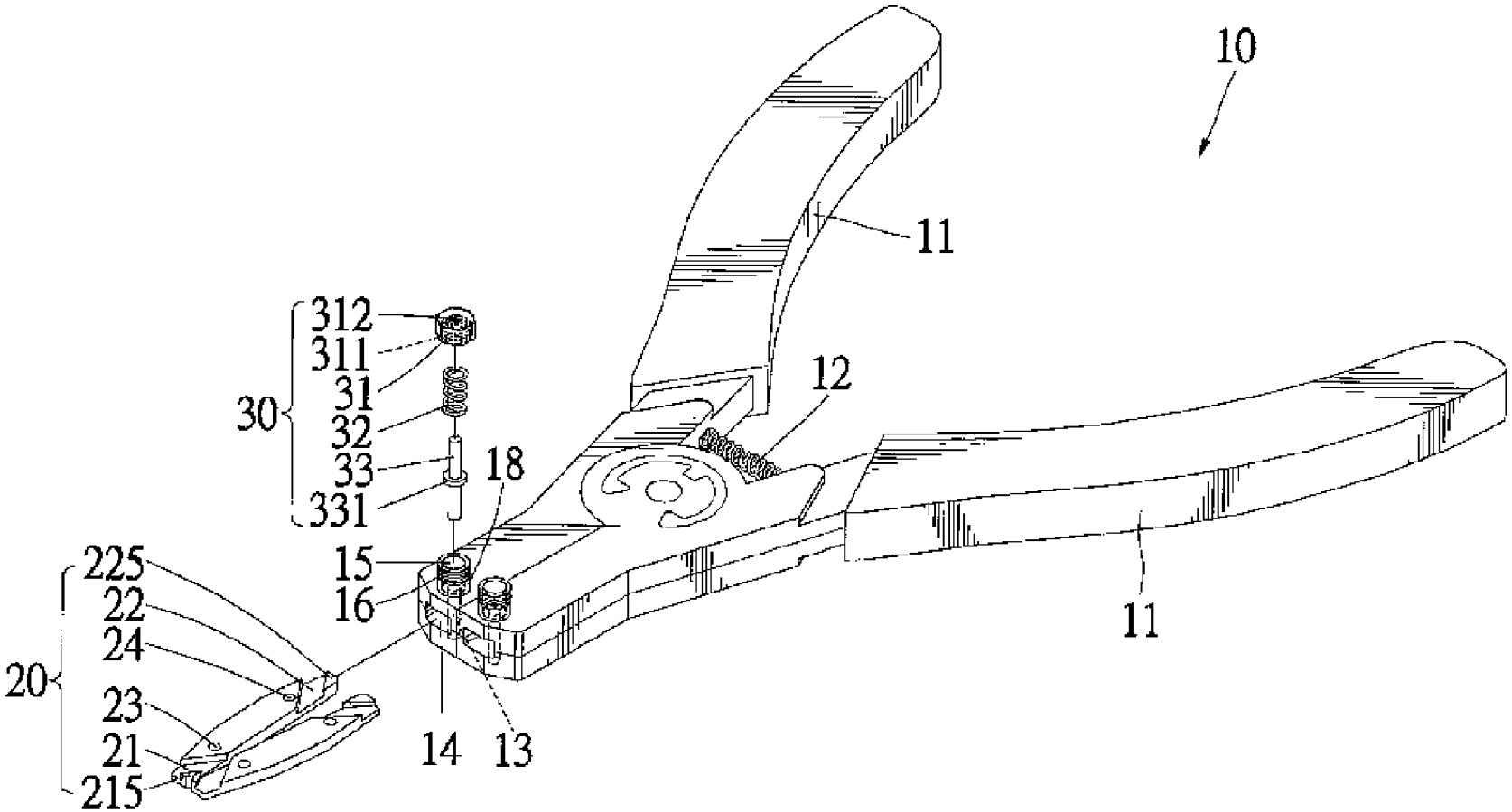
FIG. 2 is an exploded view of the pair of pliers shown in FIG. 1.

Referring to FIG. 2, the second end of each handle 11 defines a longitudinal hole 13 and a transverse hole 14 communicated with the longitudinal hole 13. The longitudinal holes 13 include a rectangular profile corresponding to that of the jaws 20. The longitudinal holes 13 gets smaller in a direction to the first end from the second end of each handle 11. A cylinder 16 is formed on the second end of each jaw 11. Each cylinder 16 defines a space 15 communicated with a related transverse hole 14. A thread 18 is formed on the external side of each cylinder 16.

Figure 3:
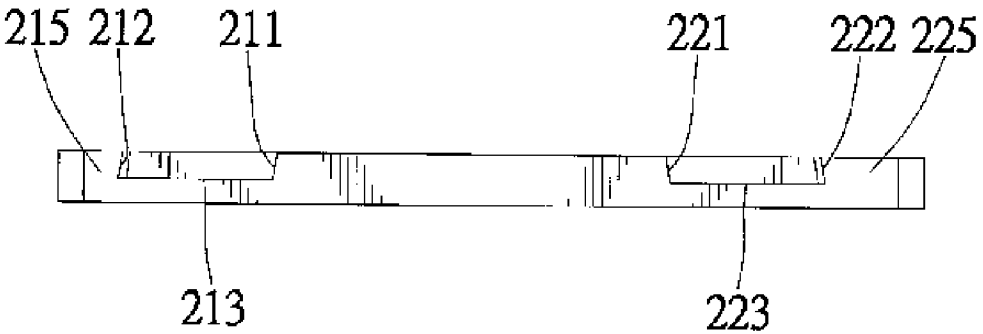
FIG. 3 is a side view of a jaw used in the pair of pliers of FIG. 2.

Referring to FIGS. 2 through 4, each jaw 20 includes a first end and a second. Selective one of the ends of each jaw 20 is inserted into a related transverse hole 13. The ends of each jaw 20 taper. Each jaw 20 defines an oblique groove 22 near the first end, an oblique groove 21 near the second end, an aperture 24 near the oblique groove 22 and an aperture 23 near the oblique groove 21. As best shown in FIG. 3, the oblique groove 22 is defined by two walls 221 and 222 and a floor 223. The angle between the wall 221 and the floor 223 is obtuse. The angle between the wall 222 and the floor 223 is sharp. A block 225 is formed beside the wall 222. A chamfer 224 is formed on the block 225. The oblique groove 21 is defined by two walls 211 and 212 and a floor 213. The angle between the wall 211 and the floor 213 is obtuse. The angle between the wall 212 and the floor 213 is sharp. A block 215 is formed beside the wall 212. A chamfer 214 is formed on the block 215.

Referring to FIG. 2, each quick-release device 30 includes a pin 33, a spring 32 and a cap 31. A flange 331 is formed on the pin 33, thus dividing the pin 33 into a first end and a second end. The first end of the pin 33 can be inserted into selective one of the apertures 24 and 23 in order to keep selective one of the ends of each jaw 20 in the longitudinal hole 13 of a related handle 11. The spring 32 is provided on the second end of the pin 33. The cap 31 includes a thread 311 defined in an internal side and an aperture 313 defined therein. The thread 311 is engaged with a related thread 18 so that the cap 31 is engaged with a related cylinder 16. Hence, the pin 31 and the spring 32 are kept in a related cylinder 16. The flange 331 is in contact with the second end of a related handle 11 on a side and in contact with the spring 32 on an opposite side. The spring 32 is compressed between the flange 331 and the cap 31 in order to keep the first end of the pin 33 in the aperture 24 or 23 of each jaw 20. The second end of the pin 33 is inserted through the aperture 312.

Referring to FIG. 5, the E-shaped snap ring 42 includes two portions each put in the oblique groove 21 of each jaw 20. Each portion of the E-shaped snap ring 42 is put against the block 215 of a related jaw 20. When the first ends of the handles 11 are closed, the jaws 20 are opened. Hence, the E-shaped snap ring 42 is opened. While the E-shaped snap ring 42 is opened, it can easily be provided onto or moved from a reduced neck 41 of a rod 40.

Figure 6:
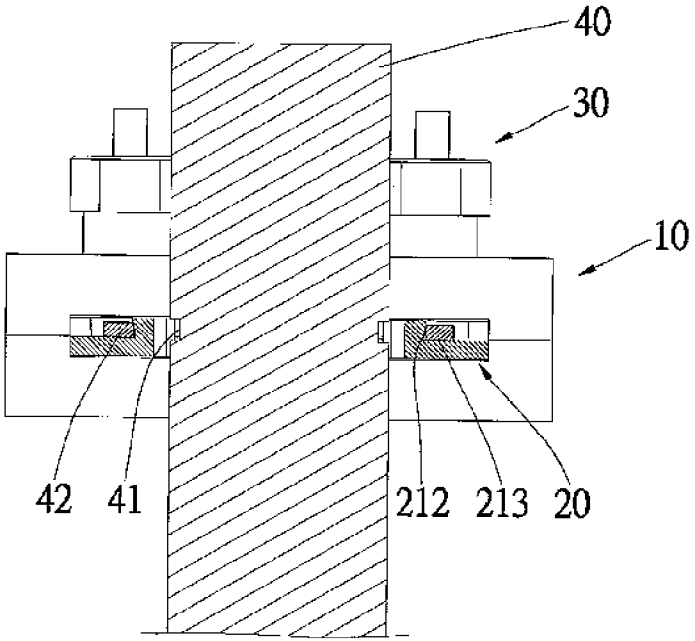
FIG. 6 is a cross-sectional view taken along a line 6—6 in FIG. 1.

Referring to FIG. 6, the sharp angle between the wall 212 and the floor 213 of each oblique groove 21 ensures firm positioning of each portion of the E-shaped snap ring 42 in the oblique groove 21.

The obtuse angle between the wall 211 and the floor 213 of each oblique groove 21 facilitates smooth moving of each portion of the E-shaped snap ring 42 from the oblique groove 21.

Figure 7:
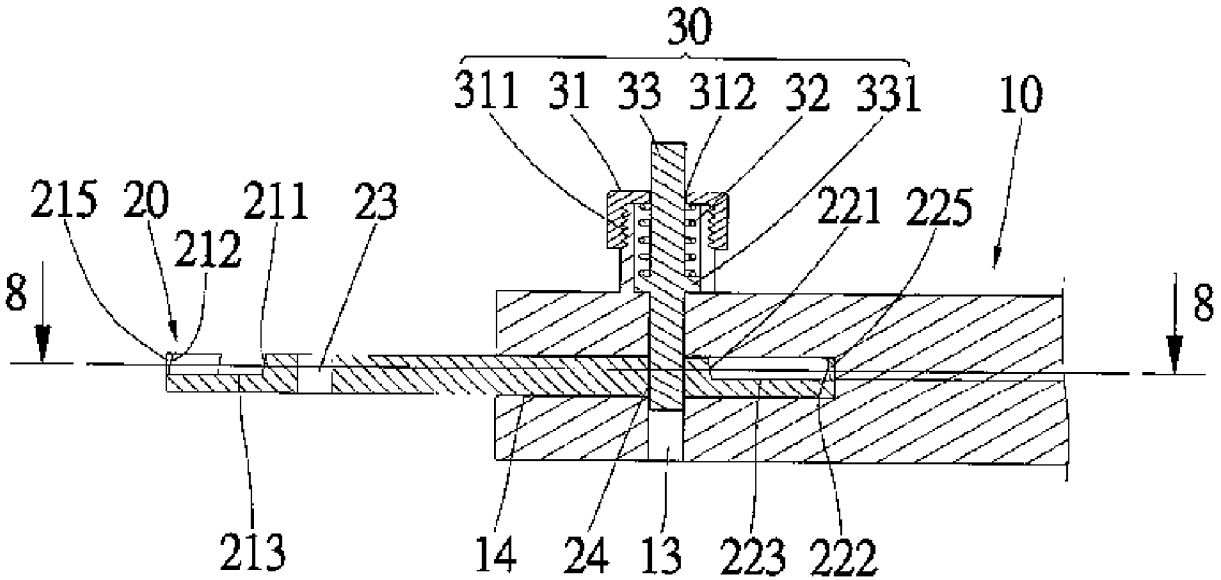
FIG. 7 is another cross-sectional view of the pair of pliers shown in FIG. 5.
Figure 8:
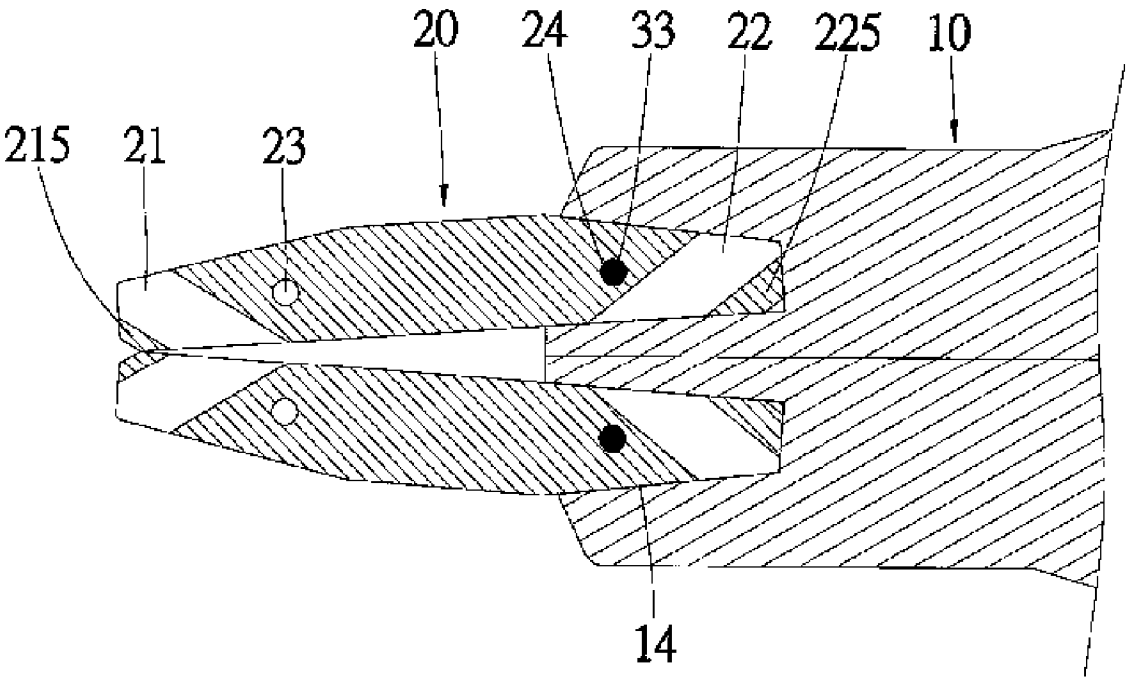
FIG. 8 is a cross-sectional view taken along a line 8—8 in FIG. 7.

Referring to FIGS. 7 and 8, the first end of a pin 30 is inserted in the aperture 24 of a related jaw 20. Thus, the first end of the jaw 20 is kept in the longitudinal hole 13 of a related handle 11. Therefore, the jaw 20 cannot be moved from the handle 11.

Figure 9:
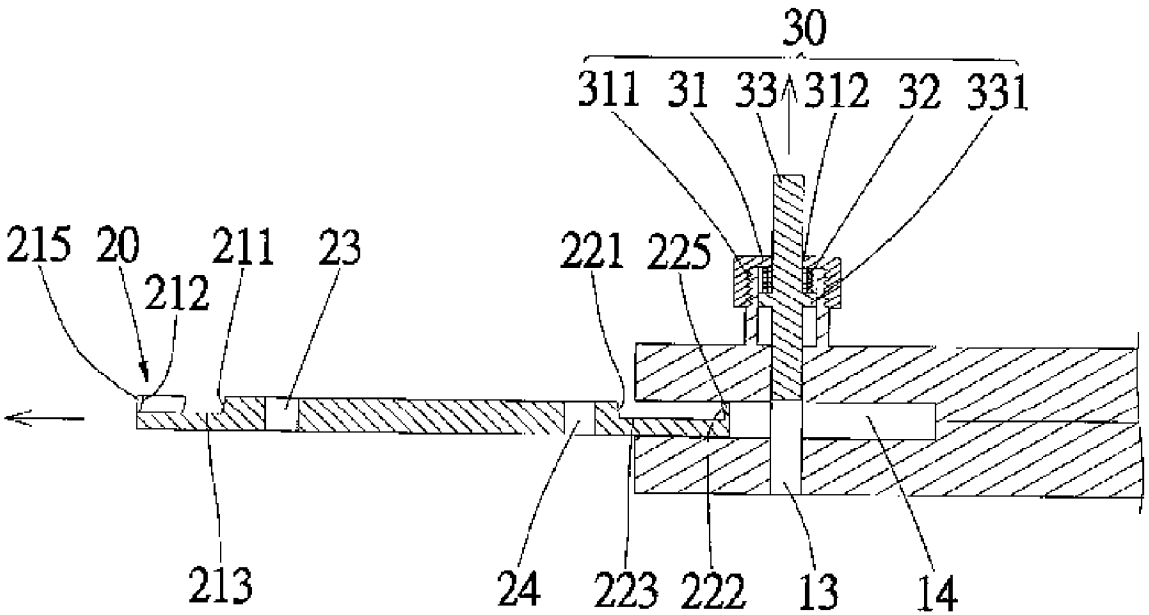
FIG. 9 is similar to FIG. 7 but shows the pair of pliers in a different position.
Figure 10:
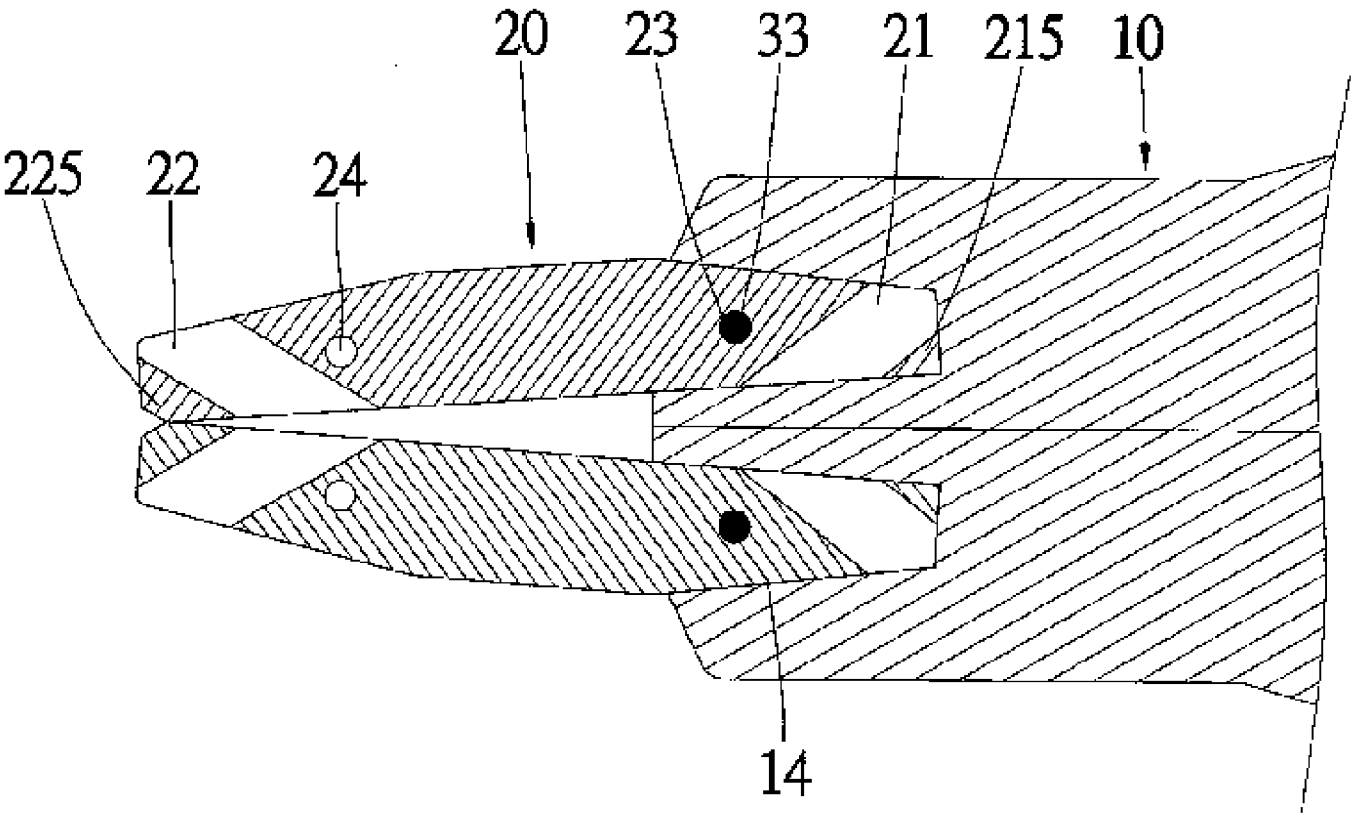
FIG. 10 is similar to FIG. 8 but shows the jaws in a different position.

Referring to FIGS. 9 and 10, the second end of a pin 30 is pulled so that the first end of the same is moved from the aperture 24 of a related jaw 20. Thus, the first end of the jaw 20 can be moved from the longitudinal hole 13 of a related handle 11. If desired, the second end of the jaw 20 can be inserted into the longitudinal hole 13 of the handle 11. As the second end of the pin 33 is pulled, the spring 32 is further compressed. When the second of the pin 33 is released, the spring 32 returns the pin 33 to the position shown in FIGS. 7 and 8.

Figure 11:
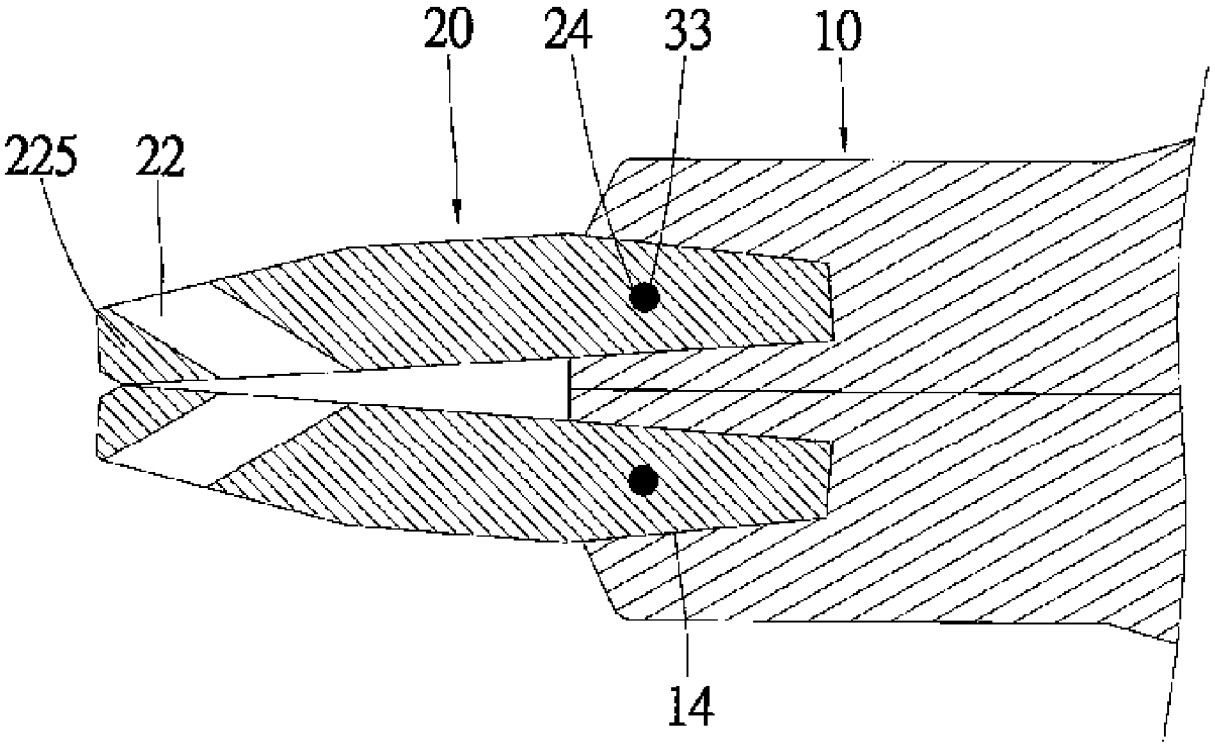
FIG. 11 is a cross-sectional view of a pair of pliers for E-shaped snap rings according to a second embodiment of the present invention.

FIG. 11 shows two jaws 20 according to a second embodiment of the present invention. Each jaw 20 of the second embodiment is similar to each jaw 20 of the first embodiment except including only one oblique groove 22, only one aperture 24 and only one block 225.

Figure 12:
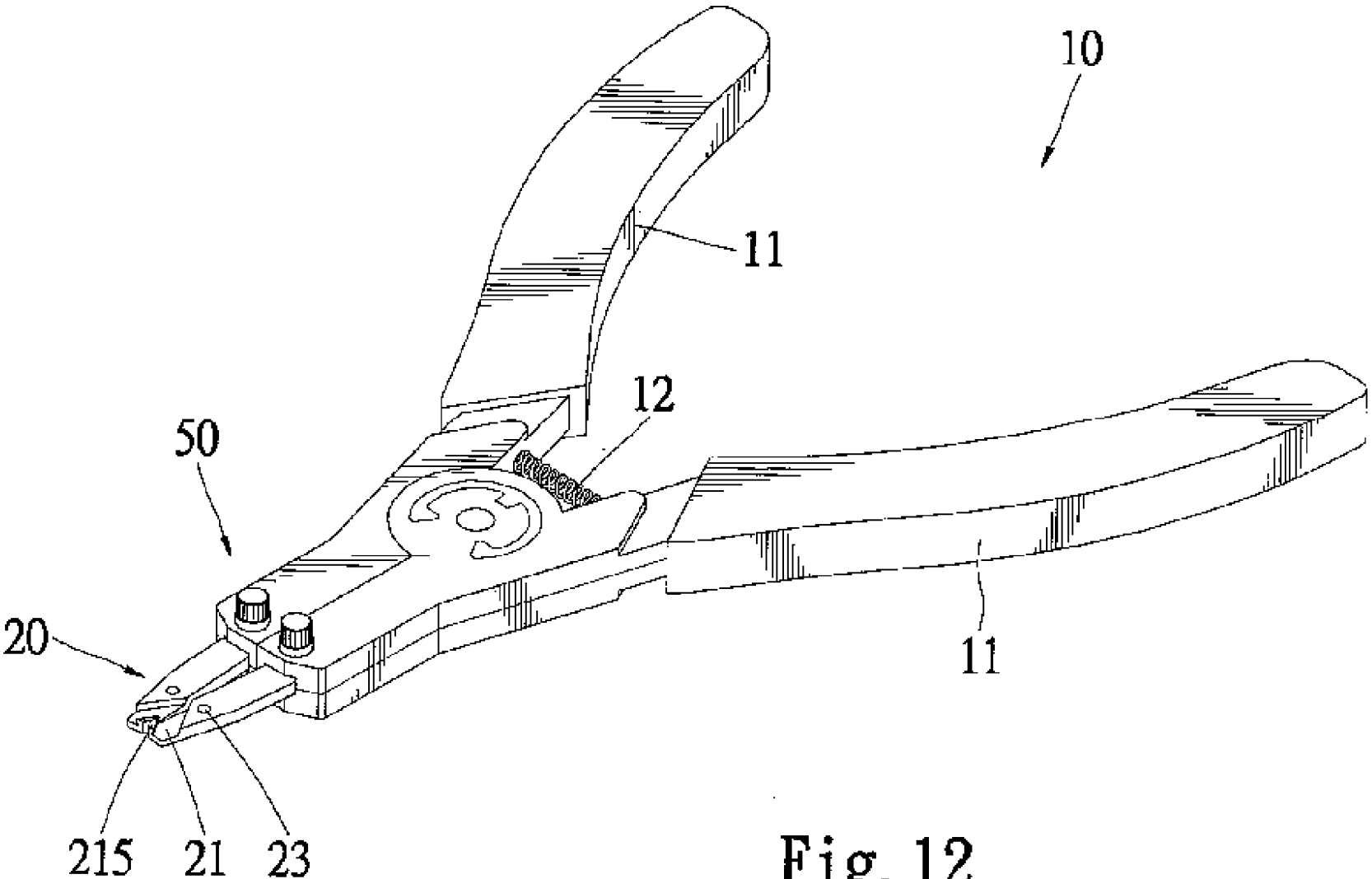
FIG. 12 is a cross-sectional view of a pair of pliers for E-shaped snap rings according to a third embodiment of the present invention.
Figure 13:
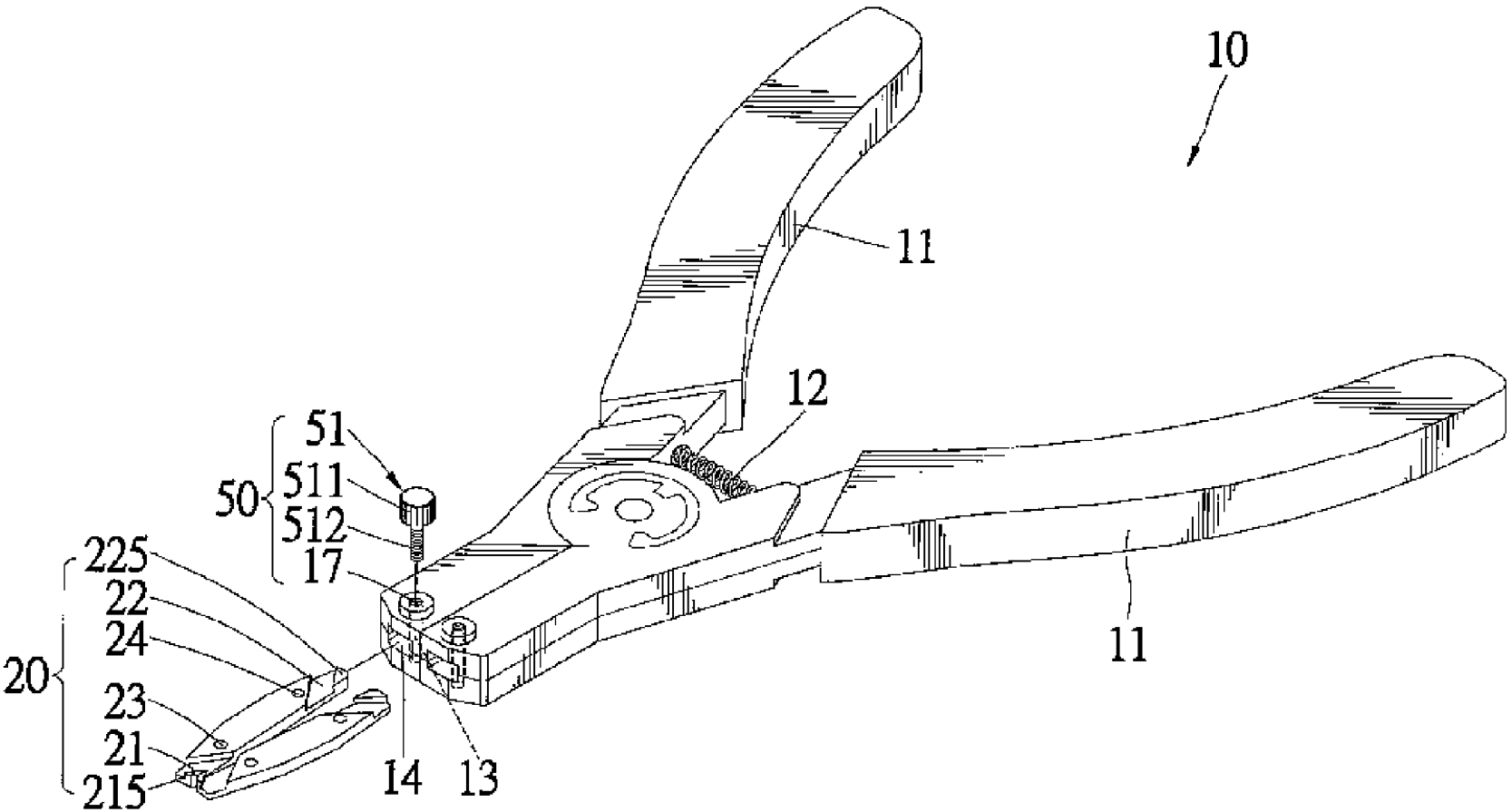
FIG. 13 is an exploded view of the pair of pliers shown in FIG. 12.

FIGS. 12 and 13 show a pair of pliers according to a third embodiment of the present invention. The third embodiment is similar to the first embodiment except including fastening devices 50 instead of the quick-release devices 30. Each fastening device 50 includes a screw 51. The screw 51 includes a head 511, a body (not numbered) extended from the head 511 and a thread 512 formed on the body. A thread 17 is formed on the wall of the wall of each transverse hole 14. The body of the screw 51 acts like the first end of each pin 33. The thread 512 can be engaged with a related thread 17 in order to keep the body of the screw 51 in the aperture 24 or 23 of each jaw 20.

The present invention has been described through the detailed illustration of the embodiments. Those skilled in the art can derive variations from the embodiments without departing from the scope of the present invention. Therefore, the embodiments shall not limit the scope of the present invention defined in the claims.

What is claimed is:

1. A pair of pliers for E-shaped snap rings, the pair of pliers comprising:

two handles pivotally connected with each other, each of the handles comprising a first end and a second end so that the first ends of the handles are opened when the second ends of the handles are closed; and two jaws each comprising a first end connected with the second end of one of the handles in a detachable manner, a second end, and an oblique groove defined therein near the second end for receiving a portion of an E-shaped snap ring so that the E-shaped snap ring is opened when the first ends of the handles are closed.

2. The pair of pliers according to claim 1 wherein the oblique groove of each of the jaws comprises a first wall, a second wall for contact with the portion of the E-shaped snap ring, and a floor between the walls.

3. The pair of pliers according to claim 2 wherein the angle between the second wall and the floor is sharp in order to ensure firm positioning of the portion of the E-shaped snap ring in the oblique groove.

4. The pair of pliers according to claim 2 wherein the angle between the first wall and the floor is sharp in order to facilitate smooth moving of the portion of the E-shaped snap ring from the oblique groove.

5. The pair of pliers according to claim 1 wherein the second end of each of the jaws can alternatively be connected with the second portion of one of the handles, wherein each of the jaws comprises an additional oblique groove defined therein near the first end for receiving a portion of an E-shaped snap ring.

6. The pair of pliers according to claim 5 wherein the additional oblique groove of each of the jaws comprises a first wall, a second wall for contact with the portion of the E-shaped snap ring, and a floor between the walls.

7. The pair of pliers according to claim 6 wherein the angle between the second wall and the floor is sharp in order to ensure firm positioning of the portion of the E-shaped snap ring in the additional oblique groove.

8. The pair of pliers according to claim 6 wherein the angle between the first wall and the floor is sharp in order to facilitate smooth moving of the portion of the E-shaped snap ring from the additional oblique groove.

9. The pair of pliers according to claim 1 wherein each of the handles comprises a longitudinal hole in the second end in order to receive the first end of one of the jaws.

10. The pair of pliers according to claim 9 comprising a quick-release device for keeping the first end of each of the jaws in the longitudinal hole of one of the handles.

11. The pair of pliers according to claim 10 wherein each of the jaws defines an aperture near the first end thereof, wherein each of the handles defines a transverse hole communicated with the longitudinal hole, wherein the quick-release device comprises a pin comprising a first end for insertion in the aperture of each of the jaws through the transverse hole of one of the handles and a second end to be pulled.

12. The pair of pliers according to claim 11 wherein the quick-release device comprises a spring for biasing the pin in order to keep the pin inserted in the aperture of each of the jaws.

13. The pair of pliers according to claim 12 wherein the pin comprises a flange formed thereon and biased by means of the spring.

14. The pair of pliers according to claim 13 wherein the quick-release device comprises a cap installed on each of the jaws so as to keep the spring and the pin in position.

15. The pair of pliers according to claim 14 wherein the cap defines an aperture through which the second end of the pin is inserted to be pulled.

16. The pair of pliers according to claim 14 wherein each of the jaws comprises a cylinder formed thereon for engagement with the cover.

17. The pair of pliers according to claim 16 wherein the cylinder comprises a thread formed thereon, wherein the cap comprises a thread formed thereon for engagement with the thread of the cylinder.

18. The pair of pliers according to claim 9 comprising a fastening device for keeping the first end of each of the jaws in the longitudinal hole of one of the handles.

19. The pair of pliers according to claim 18 wherein each of the jaws defines an aperture near the first end thereof, wherein each of the handles defines a transverse hole communicated with the longitudinal hole, wherein the fastening device comprises a screw for insertion in the aperture of each of the jaws through the transverse hole of one of the handles and a second end to be pulled.

20. The pair of pliers according to claim 19 wherein the screw comprises a thread formed thereon for engagement with a thread formed on the wall of the transverse hole.

21. The pair of pliers according to claim 1 comprising a spring compressed between the first portions of the handles in order to keep the first portions of the handles open.

* * * * *